US005775537A

United States Patent [19]

Doyle, Jr.

[11] Patent Number: 5,775,537

[45] Date of Patent: Jul. 7, 1998

[54] MERCHANDISE DISPENSER

[75] Inventor: Merton G. Doyle, Jr., Sarasota, Fla.

[73] Assignee: HIGA Development Corporation, Sarasota, Fla.

[21] Appl. No.: 557,469

[22] Filed: Nov. 14, 1995

[51] Int. Cl.[6] ..... G07F 11/00

[52] U.S. Cl. ..... 221/85; 221/82; 221/83; 221/84; 221/86; 221/119; 221/121; 221/3; 273/118 R

[58] Field of Search ..... 221/82–86, 281, 221/119, 121, 2, 3, 195; 273/118 R

[56] References Cited

U.S. PATENT DOCUMENTS

| | | | |
|---|---|---|---|
| 407,946 | 7/1889 | Vaughn | 221/82 |
| 1,809,001 | 6/1931 | Thoke | 221/84 |
| 2,163,280 | 6/1939 | Hibshman | 221/3 |
| 3,476,391 | 11/1969 | Fejko | 273/124 |
| 3,780,909 | 12/1973 | Callahan et al. | 221/82 |
| 3,831,807 | 8/1974 | Deaton et al. | 221/85 |
| 4,087,020 | 5/1978 | Krakauer | 221/84 |
| 4,484,592 | 11/1984 | Burnside | 221/3 |
| 5,007,636 | 4/1991 | Pagani | 273/448 |
| 5,137,278 | 8/1992 | Schilling et al. | 273/118 |
| 5,149,093 | 9/1992 | Schilling et al. | 273/118 |
| 5,397,125 | 3/1995 | Adams | 273/138 |
| 5,415,417 | 5/1995 | Reis, Jr. | 273/447 |

*Primary Examiner*—William E. Terrell
*Assistant Examiner*—Khoi H. Tran
*Attorney, Agent, or Firm*—Joseph C. Mason, Jr.

[57] ABSTRACT

A merchandise dispenser for dispensing merchandising prizes which are used in conjunction with coin operated amusement games. It includes a conveyor belt that follows a continuos path of travel within a housing, a control cabinet having an interface device which is connected to a remote coin operated device which offers an award based upon a score, points or achievement, a prize retrieval space contained within the housing, and an access door formed in the front of the housing to retrieve a prize.

17 Claims, 1 Drawing Sheet

MERCHANDISE DISPENSER

BACKGROUND OF THE INVENTION

1. Field of the Invention

This invention relates, generally, to a device and method for dispensing merchandising prizes which are used in conjunction with coin operated amusement games.

2. Description of the Prior Art

Many coin operated amusement games are designed so that a player accumulates a score during play. At the end of the game tokens, tickets or cards are dispensed to the player which correlate to that score. The player then redeems the tokens, tickets or cards for prizes and merchandise. Generally, the player must leave the game area to collect his prize or merchandise. Consequently, the redemption process necessitates that the player discontinue play.

Coin operated merchandise dispensing machines generally require the use of a plastic capsule or a shrink wrap on a cardboard backing in order to dispense merchandise. The use of plastic capsules necessitates a holding chamber which is large enough to accommodate the encapsulated prizes. Further, a purchaser must then dispose of the plastic capsule after removing the merchandise.

Accordingly, there is a need for a prize dispensing machine that eliminates the step of requiring a player to redeem tickets, tokens or cards from a game in exchange for retail merchandise. Further, there is a need for a merchandise dispensing machine that does not require the use of a plastic capsule to dispense merchandise. However, in view of the prior art considered as a whole at the time the present invention was made, it was not obvious to those of ordinary skill in this art how these needs could be met.

SUMMARY OF THE INVENTION

The long-standing but heretofore unfulfilled need for a device and method that enables the dispensing of prizes and merchandise that does not require the use of plastic capsules or the discontinuance of play to obtain the prize or merchandise is met by a device which is used in conjunction with coin operated amusement games. Accordingly, the discontinuation of play and the use of plastic capsules to obtain prizes and merchandise is avoided.

The novel method is carried out by an apparatus that is used in conjunction with a coin operated amusement game which has the ability to drive a ticket, token or card dispenser. The winners prize merchandise dispenser vends prizes directly to the player, replacing the ticket or token dispenser. This eliminates the step of the player having to redeem tickets dispensed from a game in exchange for retail merchandise.

The novel prize dispenser, which is driven by an onboard microprocessor, has many unique features. It vends non-encapsulated prizes of various sizes, has a programmable vend point level at which prizes are vended, and includes accumulators which store and increment ticket, token, card or merchandise vend signals received from each host game. It also includes visual and audio alerts which are activated to notify a player that a prize has been vended. For example, a beacon or strobe for each host game and a single mechanical bell are employed to notify a player that a prize has been dispensed. In addition, LED displays continually indicate a player's accumulated points and the required vend point level for each host game. Further, a low merchandise indicator signals an attendant when re-loading of prize merchandise is needed. The novel dispenser also includes a mechanical meter lockout function that prevents erroneous prize accountability while the dispenser is being serviced. The dispenser further includes a tamper-proof prize door assembly which is incorporated into the system to prevent players or others from accessing the internal workings of the device.

The novel device is a self-contained merchandise dispensing accessory designed for use in conjunction with coin operated amusement games having the ability to drive a ticket, token or card dispenser. Specifically, it is designed to simultaneously connect directly to the vend control ports of two games, and interface with each game in continuous mode. The prize dispenser's operation is transparent to each host game while it stores vend signals which it receives from the host game or games and vends a prize when a pre-programmed point level is reached.

From a structural pespective, the novel merchandise dispenser includes a housing having a top wall, a forward wall inclined downwardly from said top wall, (to facilitate unobstructed viewing of the merchandise by the player) a front wall, a bottom wall, a rear wall, and a pair of side walls. A conveyor belt follows a continuous path of travel within said housing; the belt is longitudinally oriented in a vertical plane, i.e., it rotates about a transverse horizontal axis. More particularly, it rotates in a first, forward direction parallel to the top wall, a second, downwardly inclined direction parallel to the forward wall, a third, downward direction, a fourth, rearward direction parallel to the bottom wall, and a fifth, upward direction parallel to the rear wall so that prize items carried by the conveyor belt fall from such conveyor belt under influence of gravity at a forward end thereof as said path of travel of said conveyor belt turns from said second direction to said third direction.

A prize retrieval space is defined within the housing at a forward end thereof, said prize retrieval space having an open upper end and being positioned directly below the forward end of the conveyor belt where its path of travel turns from said second direction to said third direction so that a falling prize item is deposited into the prize retrieval space under the influence of gravity.

An access door is formed in the front wall of the housing; a prize deposited into the prize retrieval space is retrieved by a player upon opening of such access door. A bias means biases the access door into a normally closed position where such door is coplanar with the front wall of the housing. The access door closes the prize retrieval space when such door is open, thereby barring access into any part of the housing other than the prize retrieval space.

Prize items are charged into the device through a loading door which is formed in the downwardly sloping forward wall of the housing. The authorized personnel who performs the recharging opens the loading door and also opens the access door, swinging it on its hinges until it closes the upwardly opening prize retrieval space. A latch on the rearward side of the access door is then accessed through the loading door so that the access door can be locked into its open position. When so locked, it becomes a downwardly sloped ramp that directs items charged into the housing through said loading door to bypass the now-closed prize retrieval space and to enter into the lower part of the housing. In this way, prize items must travel a complete circuit through the housing before being dispensed; thus, the size of the housing determines its prize-holding capacity.

These and other features will be described in more detail as this disclosure proceeds.

It is thus understood that the primary object of this invention is to provide an apparatus and method that enables a player to obtain prizes and merchandise without requiring a break in the action.

Another important object is to accomplish the foregoing object without requiring the use of plastic capsules for dispensing merchandise.

Still further objects include the provision of such an apparatus in a form that is attachable to any size or type of coin operated amusement game.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying swings, in which:

The FIG. 1 is a longitudinal sectional view of an illustrative embodiment of the invention.

DETAILED DESCRIPTION OF THE PREFERRED EMBODIMENT

Figure 1:
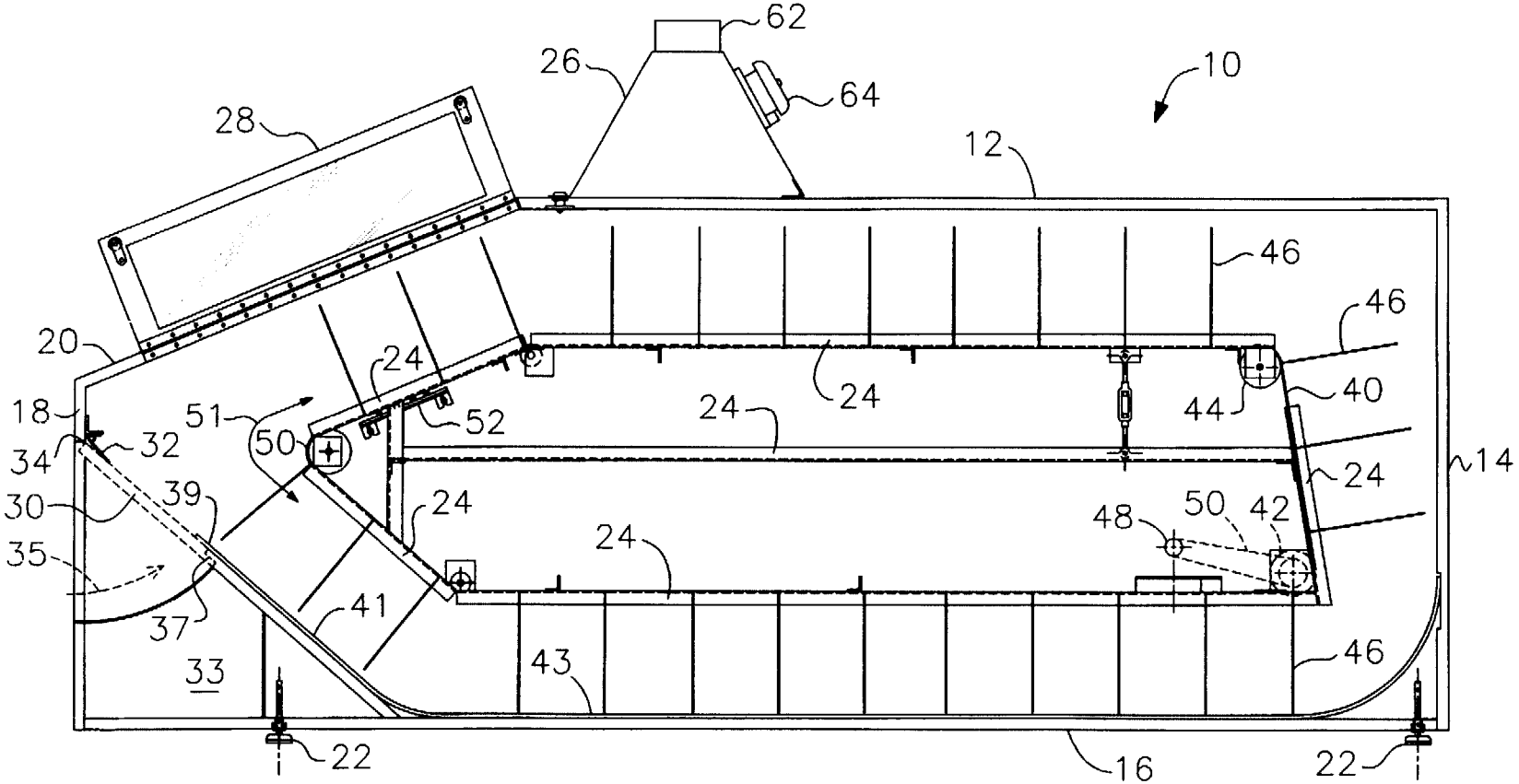

Referring now to FIG. 1 it will there be seen that an exemplary embodiment of the novel dispenser is denoted as a whole by the reference numeral 10.

Dispenser 10 is a box-like structure having a flat, horizontally disposed top wall 12, a flat, vertically disposed back wall 14, a flat, horizontal bottom wall 16, and a flat, vertically disposed front wall 18. It further includes a flat, forward wall 20 that is inclined downwardly at about a twenty degree angle relative to horizontal top wall 12. The assembly is supported at its front and back by casters 22. Walls 12, 14, 16, 18, and 20 are preferably formed of plywood but may be formed of any other suitable material.

Dispenser 10 further includes a welded steel angle iron frame 24 that is enclosed within said plywood walls as depicted. The mechanical drive components, described in detail below, are mounted on welded steel angle iron frame 24. Framework 24 thus provides a stable platform for said mechanical drive components and further provides the necessary attachment points for the external panels of dispenser 10.

Control cabinet 26 surmounts top wall 12 of housing 10; it houses suitable control electronics and a power supply.

Loading door 28 is formed in downwardly inclined forward wall 20; it is depicted in its open position, but it cannot be opened by unauthorized personnel, i.e., it is equipped with security locks to prevent tampering. When open, it provides access to the conveyor bins, hereinafter described, i.e., it is opened to recharge the housing when empty or when the number of prize items is getting low. It is also interlocked to prevent inadvertent activation of the conveyor.

Access door 30 is formed in front wall 18; spring 32 provides a bias that maintains said door in a normally closed position, shown in solid lines. When a prize is delivered to delivery space 33, the player retrieves said prize by swinging door 30 about its hinge 34, thereby displacing said door into the position depicted in dashed lines, as indicated by arcuate directional arrow 35. Note that the player cannot reach into any area of device 10 other than prize retrieval area 33, i.e., door 30 is sized to close upwardly opening retrieval space 33 when said door is open.

Prizes are carried by conveyor belt assembly 40 which includes a drive roller 42 and an idler roller 44. Assembly 40 further includes sheet metal divider vanes or flights, collectively denoted 46, which are of a common size and which are riveted to belt 40 at equidistantly spaced intervals to separate prizes from one another, i.e., each flash supports one prize item. Angle framework 24 provides a trough for the conveyor to run within, thereby preventing it from mis-tracking. A 28 RPM reversible AC gearmotor 48 powers drive roller 42 via roller chain drive 50.

A vending action occurs when motor 48, under the control of a central processor unit (CPU), advances (indexes) conveyor 40 by one division or flight 46. A prize to be deposited into prize retrieval area 33 slides down its associated flight 46 and drops into said area under the influence of gravity when the particular flight 46 which is carrying it makes a turn around forward roller 50; note that each flight rotates from a generally upstanding seventy degree angle as its passes over forward wall 20 to a fifty degree downward orientation as it begins its return cycle, i.e., the flight rotates one hundred twenty degrees about said forward roller 50 as indicated by directional arrow 51.

When prize items are being deposited onto conveyor flights 46 by authorized personnel, access door 30 is opened as indicated by directional arrow 35 and swung on its hinges until it abuts the shoulder denoted 37. A sliding latch or other suitable locking means 39 is then accessed through open loading door 28 so that access door 30 is held in such fully open position. Note that said door 30 becomes a ramp when so positioned so that prize items charged into the housing through said open loading door are deflected by said ramp as they fall so that said items slide down downwardly inclined surface 41 onto level surface 43 at the bottom of the housing. Surfaces 41 and 43 are of course defined by flights 46. After the recharging operation is completed, the latch 39 is released and bias means 32 returns access door 30 to its position of repose.

A magnetic flight position sensor 52 provides the CPU with conveyor position information. Sensor 52 generates a signal that is received by the CPU and said CPU, upon receipt of said signal, stops motor 48 when conveyor 40 has advanced a distance of one flight or bin depth during vending.

Control cabinet 26 houses the novel electronic system, including the CPU board, score displays and power supply. All aspects of the prize dispenser operation are controlled by a 68HC11 based CPU board. The control software is burned into a socket mounted PROM or EPROM on the board prior to installation. A non-volatile SRAM memory is used to prevent lost data due to the interruption of electrical power. The CPU has a RS232 serial port for future expansion and system testing.

The CPU board includes mounted rotary programming switches which provide convenient programmability of vend point values. Momentary contact push-button switches provide right and left accumulator resets, conveyor motor advance and reversal, and prize counter reset. The rotary programming switches allow an end user to program and set the vend point levels within a range of 000 to 999. Each of the three digits represents a single digit, i.e., 1s, 10s, or 100s. The vend point level is the number of points which must be accumulated to activate a vend in which a prize is dispensed. The programmed value is displayed on LED displays.

The right and left accumulator reset push-buttons allow the accumulators to be manually re-set to 000 if desired. The accumulators require resetting after testing, and if an improper programming of the dispenser or host games has occurred.

Dispenser 10 has an internal prize counter which is reset to its maximum setting after reloading of the dispenser; resetting is accomplished by pushing a prize counter reset push-button. The maximum setting of the prize counter is equal to the number of prizes contained within the dispenser when the dispenser is full.

A conveyor motor advance push-button is used during reloading; each press of said button, via CPU control, causes the conveyor to advance one bin or flight. However, rapid sequential depressions of said push-button cause the conveyor to advance up to four flights or bins; this allows multiple prizes to be reloaded per conveyor advance cycle. In the preferred embodiment, up to four rapid activations of the push button may be made, allowing reloading of up to four prizes per conveyor advance cycle. Allowing the CPU to implement the conveyor advances ensures that the conveyor remains indexed to the proper position for the first vend following re-loading. A maximum advance of four was established for the conveyor motor advance because re-loading door 28 provides access to four merchandise bins at a time.

If the button is activated more than four times in quick succession, the system ignores such activations and no items are placed in the queue.

The conveyor motor reversal push-button also enables a servicer to move the conveyor in a reverse direction. However, unlike the conveyor motor advance, multiple button presses are not placed in a queue when the conveyor is in its reverse mode. Instead, the conveyor remains in motion only as long as the conveyor motor reversal push-button is depressed. The conveyor motor reversal pushbutton is used to correct merchandise jams if such jams occur. Activating the conveyor motor reversal causes the CPU to activate the direction reversal relay while also applying power to the motor; thus, the conveyor automatically stops at a preselected index position when the conveyer motor reverse button is used.

The CPU also has open collector inputs. The open collector inputs provide two motor vend signals from each host game vend port; the vend signals are enable signals from each host game vend ports. The open collector inputs further provide conveyer bin divider position sensing, using a magnetic reed switch, and further provide prize sensing as a contingency to allow detection of the presence or absence of prizes.

The CPU includes open collector outputs as well. Said open collector outputs provide two simulated notch signals that are sent to each host game vend port. The open collector outputs further provide two electromechanical counter signals to total the number of prizes vended per host game. Moreover, said open collector outputs also provide a low merchandise LED indicator lamp.

A signal ground is connected from the CPU to each of the two host game vend ports to ensure a common signal reference point. Conventional seven segment LED displays, preferably one inch in height, are mounted to the rear side of the CPU board to display the programmed vend point level, i.e., the number of points at which a vend will take place. The LED also displays the current accumulated number of vend signal pulses received from each host game. A total of twelve such displays are used, in four groups of three digits each. This arrangement provides a display range from 000 to 999 for the programmed levels and the accumulated signal pulses for each of the two host games.

Eight switched AC control channels are provided by using the solid state relays mounted on the CPU board. The AC loads currently in use include conveyor motor power, conveyor motor direction via a DPDT relay, left beacon/strobe 62, right/beacon strobe 62, electromechanical bell 64 and flashing effects lighting. Conveyor motor 48 is a 28 RPM, one-twenty-fifth hp motor which is reverseable through the cue of the DPDT AC relay. The left and right beacon/strobe outputs are used to drive small AC beacons 62 of 10 to 30 watts, or small 20 watt self triggered strobe lights, also denoted 62 to simplify the drawing. Electromechanical bell 64 is comparable to a small Benjamin or Thomas bell. The flashing effect lighting circuit is used to control rope lighting or some other small incandescent lamp for the purpose of adding visual effects to the prize dispenser. The two remaining switched AC control channels are unassigned.

A set of un-switched AC convenience connections are provided on the CPU board to power a +12 volt power supply. A second set of unassigned, un-switched AC convenience connectors is provided for future expansion. A +12 volt, three-fourths Amp DC linear power supply furnishes the current necessary to operate the CPU board.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A merchandise dispenser, comprising:

a housing having a top wall, a forward wall inclined downwardly from said top wall, a front wall, a bottom wall, a rear wall, and a pair of side walls;

a conveyor belt that follows a continuous path of travel within said housing, said conveyor belt being oriented in a vertical plane and advancing in a first, forward direction parallel to said top wall, a second, downwardly inclined direction parallel to said forward wall, a third, downward direction, a fourth, rearward direction parallel to said bottom wall, and a fifth, upward direction parallel to said rear wall so that items carried by said conveyor belt fall from said conveyor belt under influence of gravity at a forward end of said conveyor belt where said path of travel of said conveyor belt turns from said second direction to said third direction;

a control cabinet having an interface means, said interface means being connected to a remote coin operated device which offers an award based upon score, points or achievements, said control cabinet being programmed to activate said conveyor belt at a preprogrammed score, point or achievement level based on signals received by said control cabinet from said remote coin operated device through said interface means;

a prize retrieval space contained within said housing at a forward end of said housing, said prize retrieval space having an open upper end and being positioned directly below said forward end of said conveyor belt where said path of travel turns from said second direction to said third direction so that a falling prize is deposited into said prize retrieval space by influence of gravity; and an access door formed in said front wall of said housing;

whereby a prize deposited into said prize retrieval space can be retrieved by opening said access door.

2. The dispenser of claim 1, further comprising biasing means for biasing said access door into a normally closed position where said access door is coplanar with said front wall of s aid housing.

3. The dispenser of claim 1, wherein said access door closes said open upper end of said prize retrieval space when said access door is open, thereby barring access into any part of said housing other than said prize retrieval space.

4. The dispenser of claim 1, wherein said conveyor belt is formed by a plurality of flights of common size that are successively linked together, and wherein each of said flights is sized to support a single prize item thereatop.

5. The dispenser of claim 4, further comprising:

control means for indexing said conveyor belt by a distance equal to a length of one flight so that vending of a single item is accomplished by indexing said conveyor belt by an amount equal to the length of one flight.

6. The dispenser of claim 1, further comprising control means for selectively reversing said conveyor belt path of travel to facilitate unjamming of items carried by said conveyor belt.

7. The dispenser of claim 1, further comprising a loading door formed in said forward wall, said loading door enabling the introduction of prize items into said housing when said loading door is open.

8. The dispenser of claim 7, further comprising a latch means formed on a rear side of said access door, said latch means being accessible only through said loading door when said loading door is open, and said latch means being operable to lock said access door in its open position where it closes said open upward end of said prize retrieval space, said access door forming a downwardly sloping ramp means when locked in said open position, and said ramp means deflecting prize items as they are introduced into said housing through said loading door so that said prize items do not fall into said prize retrieval space, said latch means being released when charging of prize items into said housing is completed.

9. The dispenser of claim 1, further comprising means for alerting a player that a prize has been dispensed by said dispenser.

10. The dispenser of claim 9, wherein said means is a visually detectable means.

11. The dispenser of claim 9, wherein said means is an audially detectable means.

12. The dispenser of claim 7, wherein said loading door has a predetermined length equal to a predetermined number of flights so that a predetermined number of prize items can be charged into said housing at a time.

13. The dispenser of claim 1, wherein said downwardly inclined direction of said conveyor path of travel parallel to said forward wall is downwardly inclined at an angle of about twenty degrees to cause a prize item thereatop to slide down said conveyor belt prior to falling into said prize retrieval space.

14. The dispenser of claim 1, wherein said control cabinet includes a central processing unit for controlling operation of said dispenser.

15. A merchandise dispenser, comprising:

a housing having a top wall, a forward wall inclined downwardly from said top wall, a front wall, a bottom wall, a rear wall, and a pair of side walls;

a loading door formed in said forward wall, said loading door enabling the introduction of prize items into said housing when said loading door is open;

a conveyor belt that follows a continuous path of travel within said housing, said conveyor belt being oriented in a vertical plane and advancing in a first, forward direction parallel to said top wall, a second, downwardly inclined direction parallel to said forward wall, a third, downward direction, a fourth, rearward direction parallel to said bottom wall, and a fifth, upward direction parallel to said rear wall so that items carried by said conveyor belt fall from said conveyor belt under influence of gravity at a forward end of said conveyor belt where said path of travel of said conveyor belt turns from said second direction to said third direction;

a prize retrieval space contained within said housing at a forward end of said housing, said prize retrieval space having an open upper end and being positioned directly below said forward end of said conveyor belt where said path of travel turns from said second direction to said third direction so that a falling prize is deposited into said prize retrieval space by influence of gravity; and an access door formed in said front wall of said housing; and whereby a prize deposited into said prize retrieval space is retrieved by opening said access door.

16. The dispenser of claim 15, further comprising:

a latch means formed on a rear side of said access door, said latch means being accessible only through said loading door when said loading door is open, and said latch means being operable to lock said access door in its open position where it closes said open upward end of said prize retrieval space, said access door forming a downwardly sloping ramp means when locked in said open position, and said ramp means deflecting prize items as they are introduced into said housing through said loading door so that said prize items do not fall into said prize retrieval space, said latch means being released when charging of prize items into said housing is completed.

17. The dispenser of claim 15, wherein said loading door has a predetermined length equal to a predetermined number of flights so that a predetermined number of prize items can be charged into said housing at a time.

* * * * *

UNITED STATES PATENT AND TRADEMARK OFFICE

CERTIFICATE OF CORRECTION

PATENT NO. : 5,775,537
DATED : July 7, 1998
INVENTOR(S) : MERTON G. DOYLE, JR.

It is certified that error appears in the above-identified patent and that said Letters Patent is hereby corrected as shown below:

In Column 4, Line 10, the word "flash" should be changed to "flight".

Signed and Sealed this

Nineteenth Day of January, 1999

*Attest:*

*Attesting Officer*

*Acting Commissioner of Patents and Trademarks*